US007945988B2

(12) United States Patent
Gordon

(10) Patent No.: US 7,945,988 B2
(45) Date of Patent: May 24, 2011

(54) METHOD AND APPARATUS FOR CONTROLLING A VACUUM CLEANER

(75) Inventor: Evan A. Gordon, Canton, OH (US)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 1549 days.

(21) Appl. No.: 11/249,916

(22) Filed: Oct. 13, 2005

(65) Prior Publication Data

US 2009/0049639 A1 Feb. 26, 2009

(51) Int. Cl.
*A47L 5/00* (2006.01)

(52) U.S. Cl. ..... 15/319; 15/339; 15/354; 15/366

(58) Field of Classification Search ..... 15/354, 15/355, 366, 319, 339; *A47L 7/00*
See application file for complete search history.

(56) References Cited

U.S. PATENT DOCUMENTS

| | | | | |
|---|---|---|---|---|
| 4,654,924 | A | 4/1987 | Getz et al. | |
| 4,706,327 | A | 11/1987 | Getz et al. | |
| 5,274,878 | A | 1/1994 | Radabaugh et al. | |
| 6,351,872 | B1 * | 3/2002 | McCormick | 15/334 |
| 7,203,993 | B2 * | 4/2007 | Tondra et al. | 15/362 |
| 7,316,051 | B2 * | 1/2008 | Budd | 15/361 |
| 2004/0049878 | A1 * | 3/2004 | Thomas et al. | 15/320 |
| 2006/0101604 | A1 * | 5/2006 | Frederick et al. | 15/319 |

FOREIGN PATENT DOCUMENTS

| | | |
|---|---|---|
| CA | 2563631 | 4/2007 |
| EP | 0320878 | 6/1989 |
| GB | 2436789 | 10/2007 |

OTHER PUBLICATIONS

GB0620393.9 Search Report, 1 page, dated Jan. 10, 2007.

* cited by examiner

*Primary Examiner* — David A Redding
(74) *Attorney, Agent, or Firm* — Michael Best & Friedrich LLP

(57) ABSTRACT

A control system for a vacuum cleaner is disclosed. The control system includes a control pad for generating a number of user inputs. The control system further includes a serial controller for reading the state of the number of inputs and generating serial data in response thereto. The control system yet further includes a processor adapted to receive the serial data and generate control signals that controls a number of electric devices on the vacuum cleaner. A method of operating a vacuum cleaner is also disclosed.

7 Claims, 16 Drawing Sheets

METHOD AND APPARATUS FOR CONTROLLING A VACUUM CLEANER

TECHNICAL FIELD

Generally, this invention relates to vacuum cleaners. In particular, the invention relates to a apparatus for controlling a vacuum cleaner. In addition, a method of controlling a vacuum cleaner is also disclosed.

BACKGROUND OF THE INVENTION

Vacuum cleaners are generally divided into two categories. In the United States, the most popular category of vacuum cleaners is upright vacuum cleaners. Generally, upright vacuum cleaners combine a nozzle mounted suction foot with a dirt separator attached to a pivoting handle. Upright vacuum cleaners provide good carpet cleaning and ease of use. Another type of vacuum cleaner, the canister cleaner, provides a separate canister and cleaning nozzle. Canister vacuum cleaners typically provide better suction and stability at the cost of reduced cleaning power and inconvenience of maneuvering the separate canister and cleaning nozzle. The increase in suction power makes canisters effective in powering cleaning tools, but less effective in removing dirt from carpet.

Recently, the trend in upright vacuum cleaners is to incorporate on board tools to provide some of the functionality of a canister in an upright package. While these cleaners provide the increased above the floor cleaning features of functionality of the canister, they lack the stability of the canister platform. Alternately, there have been hybrid units which separate to form a canister cleaner and combine to form a upright cleaner. These machines are undesirable because they are have added complexity yet do not offer any advantage over a conventional upright or canister cleaner other than the ability to switch from one configuration to another and has the distinct disadvantage that the nozzle may not be stored in the same location when it is desired to return to canister mode.

What is needed therefore, is a vacuum cleaner that combines the advantages of upright style vacuum cleaners with the advantages of canister style vacuum cleaners which overcomes the above-mentioned drawbacks.

SUMMARY OF THE INVENTION

In accordance with a first aspect of the present invention there is provided a control system for a vacuum cleaner. The control system includes a control pad for generating a number of user inputs. The control system further includes a serial controller for reading the state of the number of inputs and generating serial data in response thereto. The control system yet further includes a processor adapted to receive the serial data and generate control signals that controls a number of electric devices on the vacuum cleaner.

In accordance with a second aspect of the present invention, there is provided method of operating a vacuum cleaner. The method includes the steps of entering a number of user inputs and converting the user inputs to a serial data. The method further includes the steps of receiving the serial data with a controller and generating a number of vacuum cleaner control signals in response to the received serial data.

DETAILED DESCRIPTION

Figure 1:
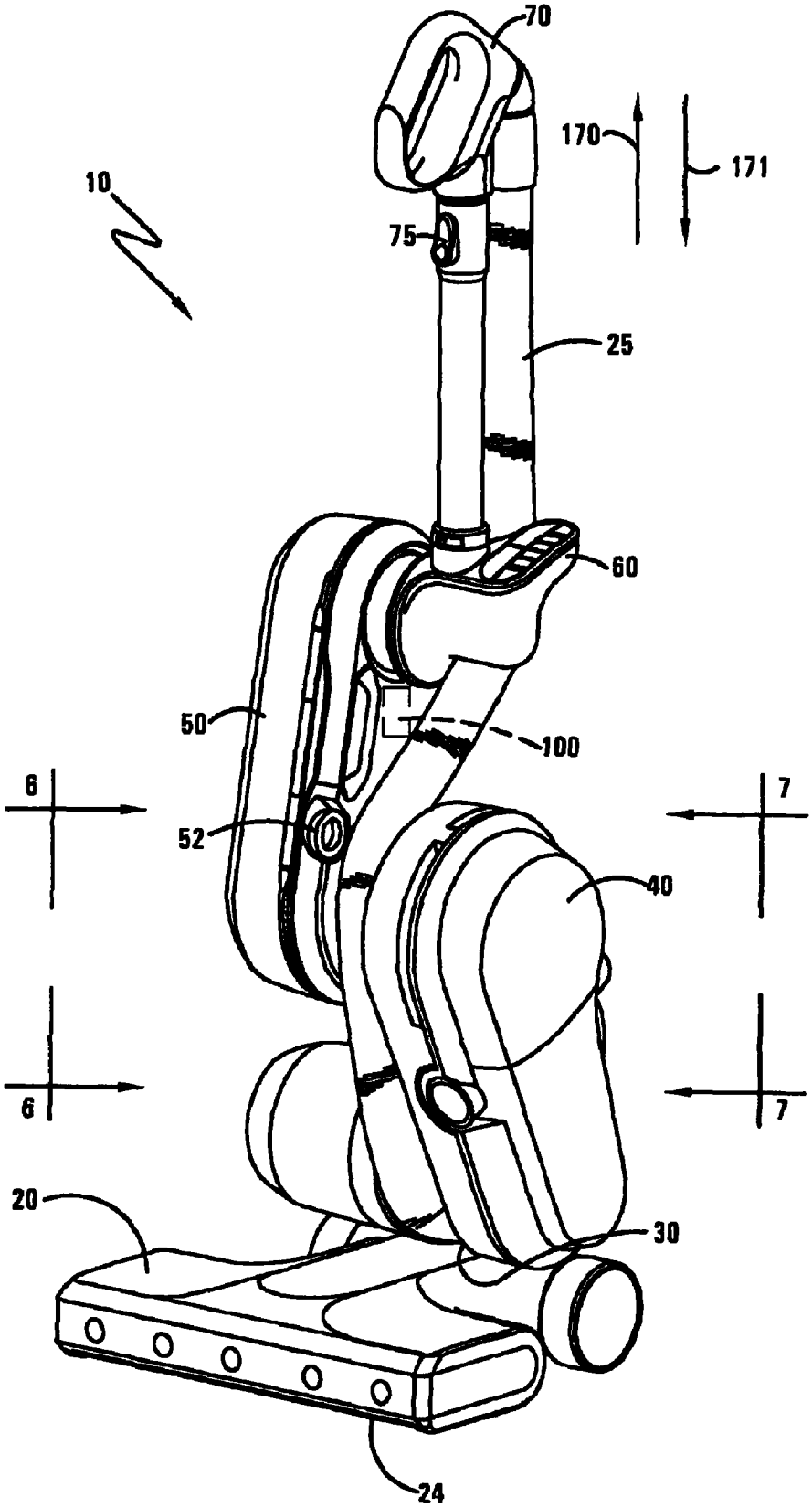
FIG. 1 is a perspective view of a vacuum cleaner in an upright storage mode which incorporates the features of the present invention therein.
Figure 2:
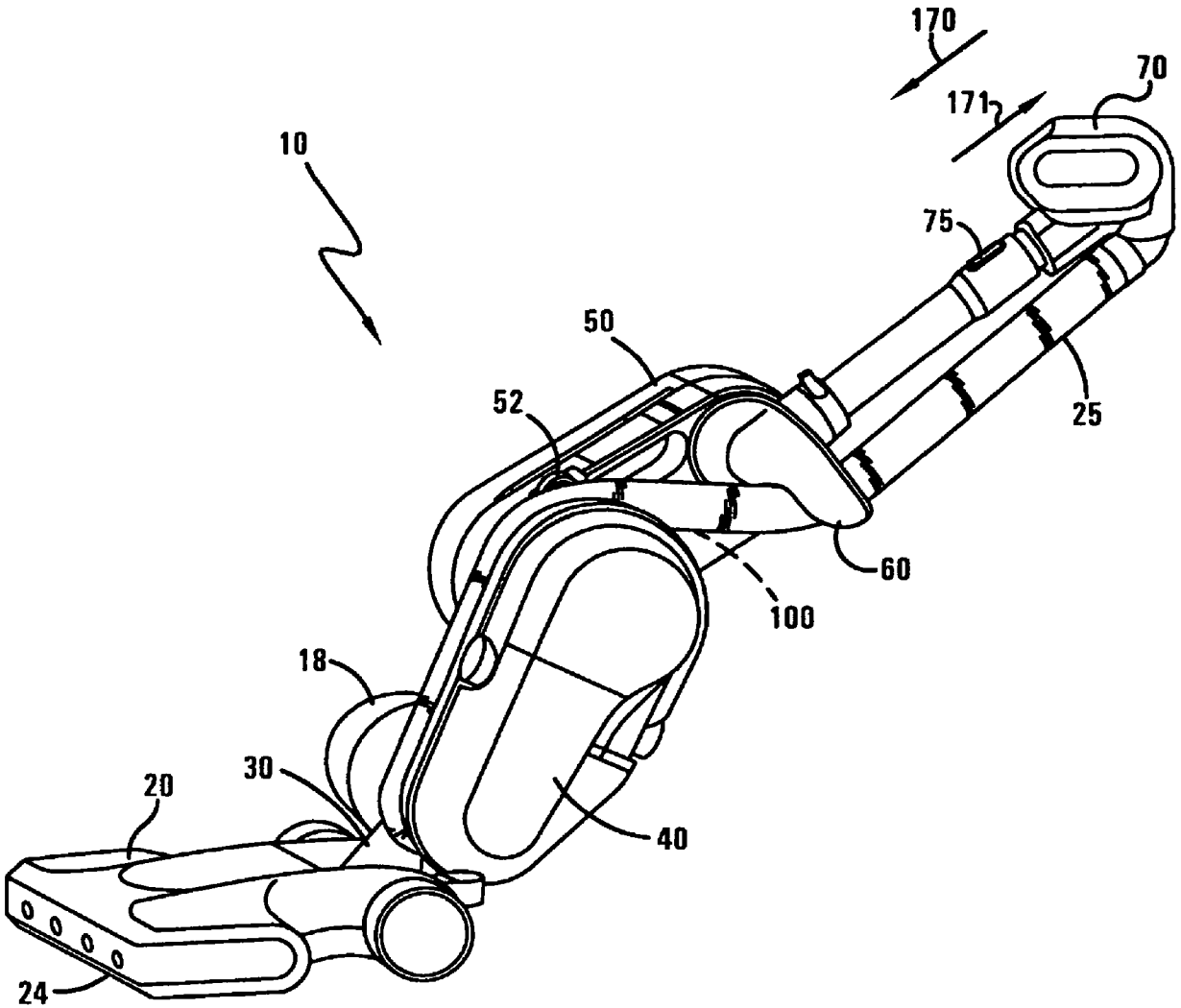
FIG. 2 is a perspective view of the vacuum cleaner of claim 1 in an upright operating mode.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIGS. 1-4, there is shown an vacuum cleaner 10 which incorporates the features of the present invention therein. The vacuum cleaner 10 includes a vacuum cleaner base or foot 20 adapted to engage a carpeted floor surface. The base 20 includes a nozzle opening 24 formed in an underside thereof for suctioning of dirt particles from a carpeted floor surface. In addition, an agitator (not shown) is positioned within the nozzle opening 24 to assist in removing dirt particles from the carpeted floor surface.

This new vacuum cleaner configuration is best represented by terms similar to the human leg. The foot 20 is pivotally connected to a ankle or link 30 (see FIG. 4). This link 30 is then connected to a calf 40. The calf 40 is then pivotally connected to the thigh 50. A control pad 60 is positioned near an upper portion of the thigh 50. A handle 70 extends from an upper portion of the thigh 50. A flexible hose 25, used for above the floor cleaning, is stored by wrapping around the joint between calf 40 and thigh 50. An upper portion of the hose 25 is positioned beneath the control pad 60. In use, the foot 20, calf 40 and thigh 50 form a Z-shape when the unit is in both the upright mode and canister mode. A number of magnets are imbedded in the link 30, calf 40, thigh 50, or control pad 60 and help hold the hose 25 in place. The magnets secure the hose to unit by magnetic attraction to metallic wire used in the hose construction.

Figure 3:
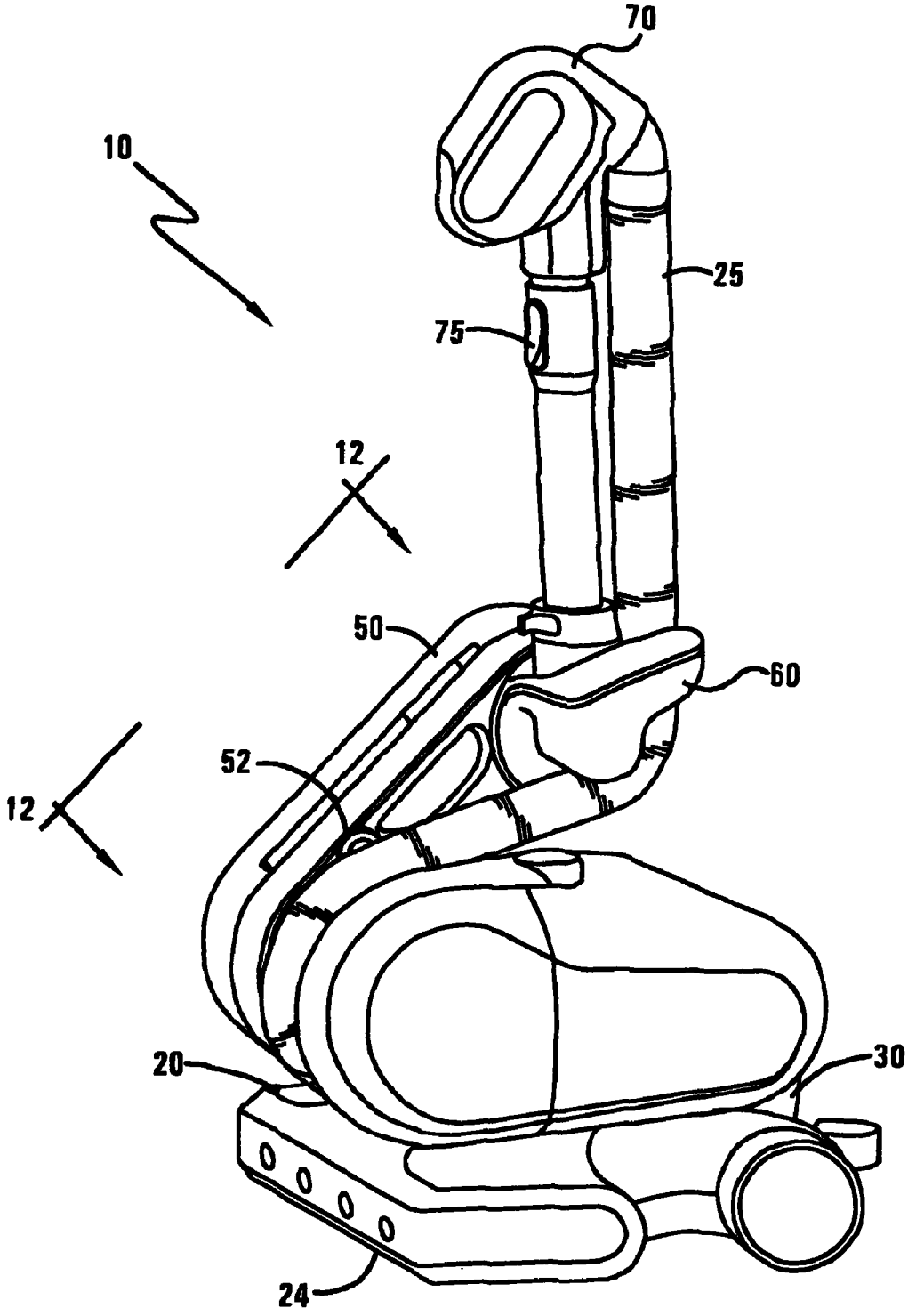
FIG. 3 is a perspective of the vacuum cleaner of FIG. 1, but showing the vacuum cleaner in a canister mode.
Figure 4:
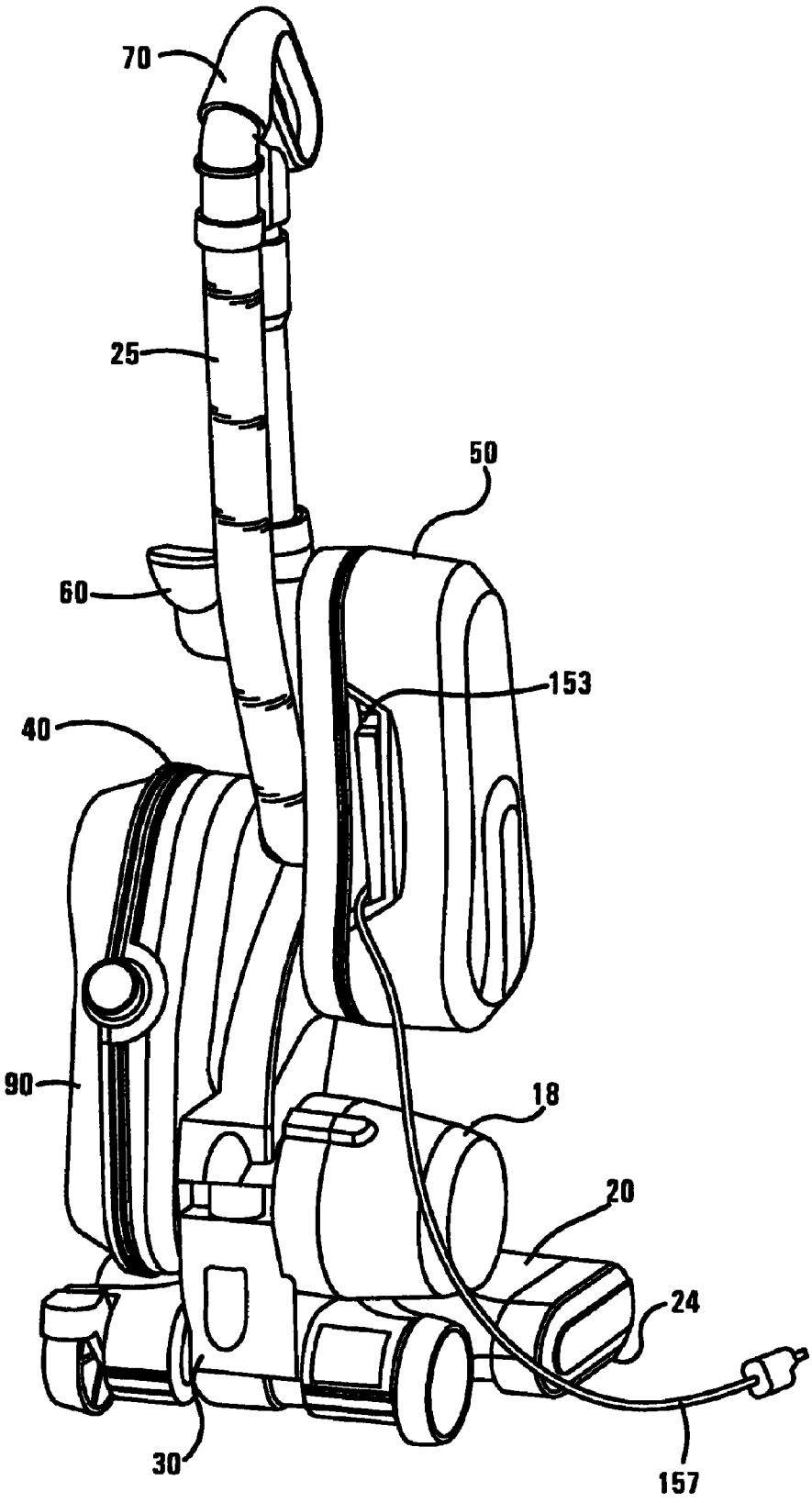
FIG. 4 is a rear perspective view of the cleaner shown in FIG. 1.

This cleaner can be configured in at least 3 modes of operation. The first mode of operation is an upright storage mode, shown in FIG. 1. The second mode of operation is an upright operating mode, shown in FIG. 2. And the final mode of operation is an canister mode, shown in FIG. 3. These three modes of operation allow the cleaner to perform either as an upright cleaner or canister as the user desires. FIG. 4 shows the a rear perspective view of the cleaner 10 that illustrates several features not viewable from the front perspective views. While the cleaner described herein is one embodiment of the present invention that could house any of dirt separation system, suction source, tool storage, control panel, cpu, cord storage adjustable length wand and above the floor cleaning hose could be placed in any one of the foot 20, link 30, calf 40 or thigh 50. In addition, if this configuration could also be adapted to a wet carpet extractor wherein any of the cleaning fluid tank, detergent tank, or wet recovery tank, could be placed in one of the foot 20, link 30, calf 40 or thigh 50.

Figure 5:
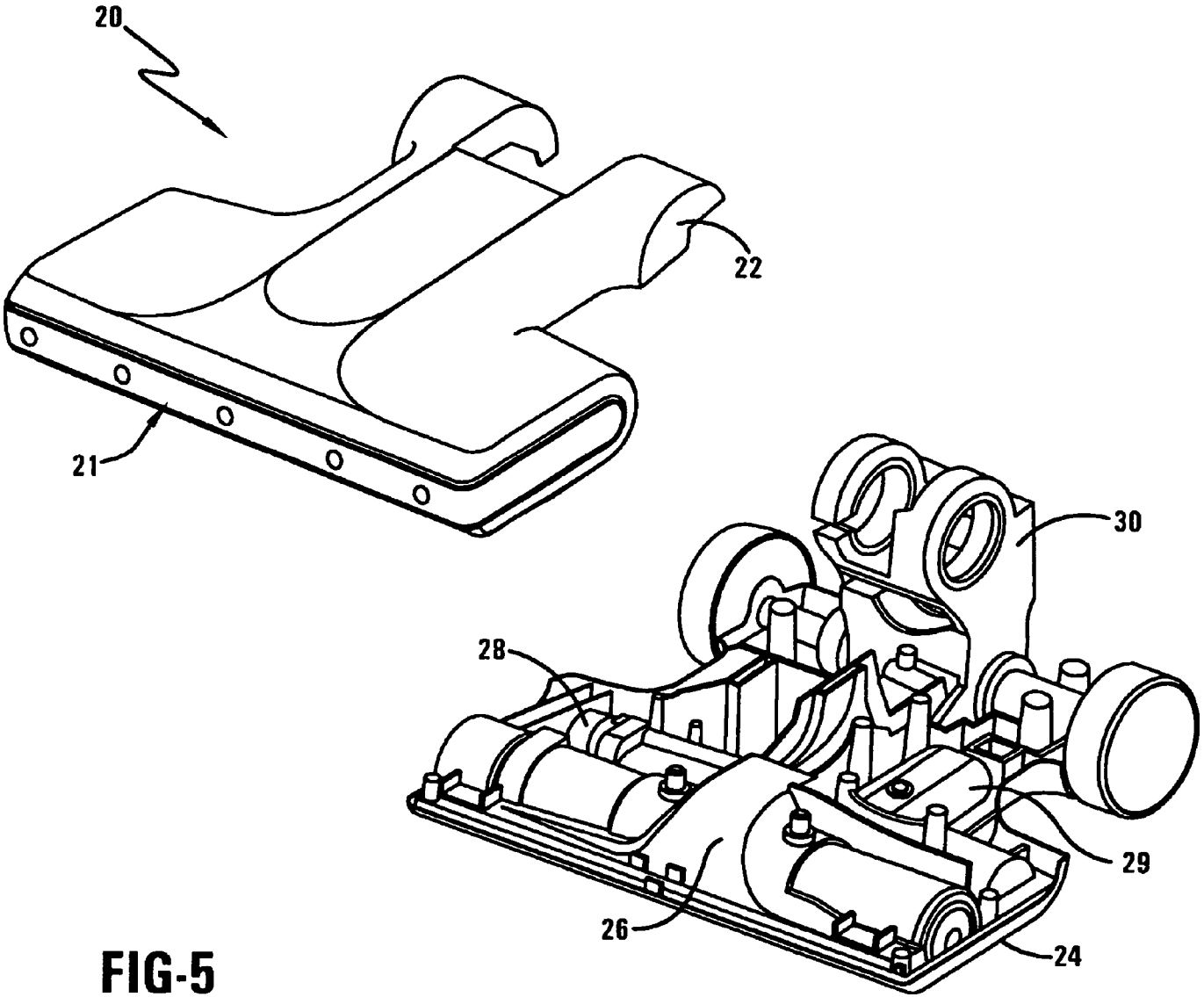
FIG. 5 is an partially exploded perspective view of the foot and link of the vacuum cleaner of FIG. 1.

Referring now to FIG. 5, there is shown the foot 20 having a hood 22 removed to view internal components. The foot includes the nozzle 24 which directs air to a duct 26 that leads to the dirt separations system, described below. The foot 20 further includes an agitator drive motor 28 and a electric height adjustment 29. The agitator drive motor 28 is operable to supply rotary power to the agitator contained within the nozzle 24. The agitator includes a number of bristles attached thereto and applies mechanical energy to a carpeted surface which aids in the removal of dirt. The electric height adjustment 29 is operative to move the nozzle 24 up and down relative to the floor surface. A led emitter array 21 is operatively positioned to transmit light through the hood 22. A cpu 100, see FIG. 1, is provided to supply control signals to control the speed of the agitator, height setting of the electric height adjustment, and power setting for the LED emitter array 21. The CPU 100 generates signals to control these elements in response to user input signals generated by the control pad 60.

The ankle or link 30 is also clearly shown in FIG. 5. The link serves as a pivot which allows the unit to move between the two upright modes. When the link is oriented vertically (as shown in FIG. 5) the unit positioned in the upright storage position (shown in FIG. 1). When the link 30 is pivoted rewards, the unit is placed in the upright operational position (shown in FIG. 2). Also, the link 30 is vertically oriented when the unit is placed in the canister mode, (shown in FIG. 3)

Figure 6:
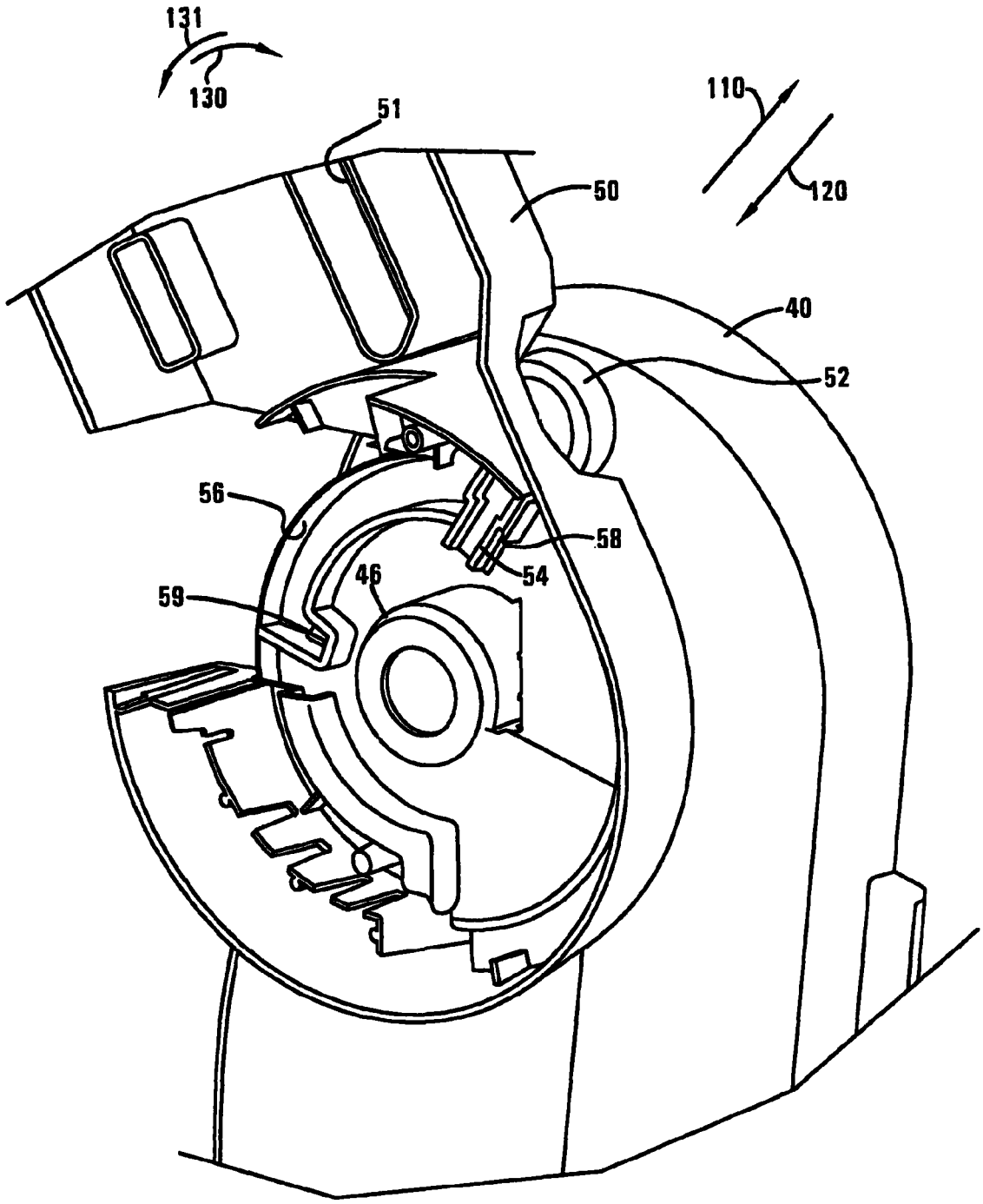
FIG. 6 is a cut away perspective view of portions of the calf and thigh of the vacuum of FIG. 1, taken along the line 6-6.
Figure 7:
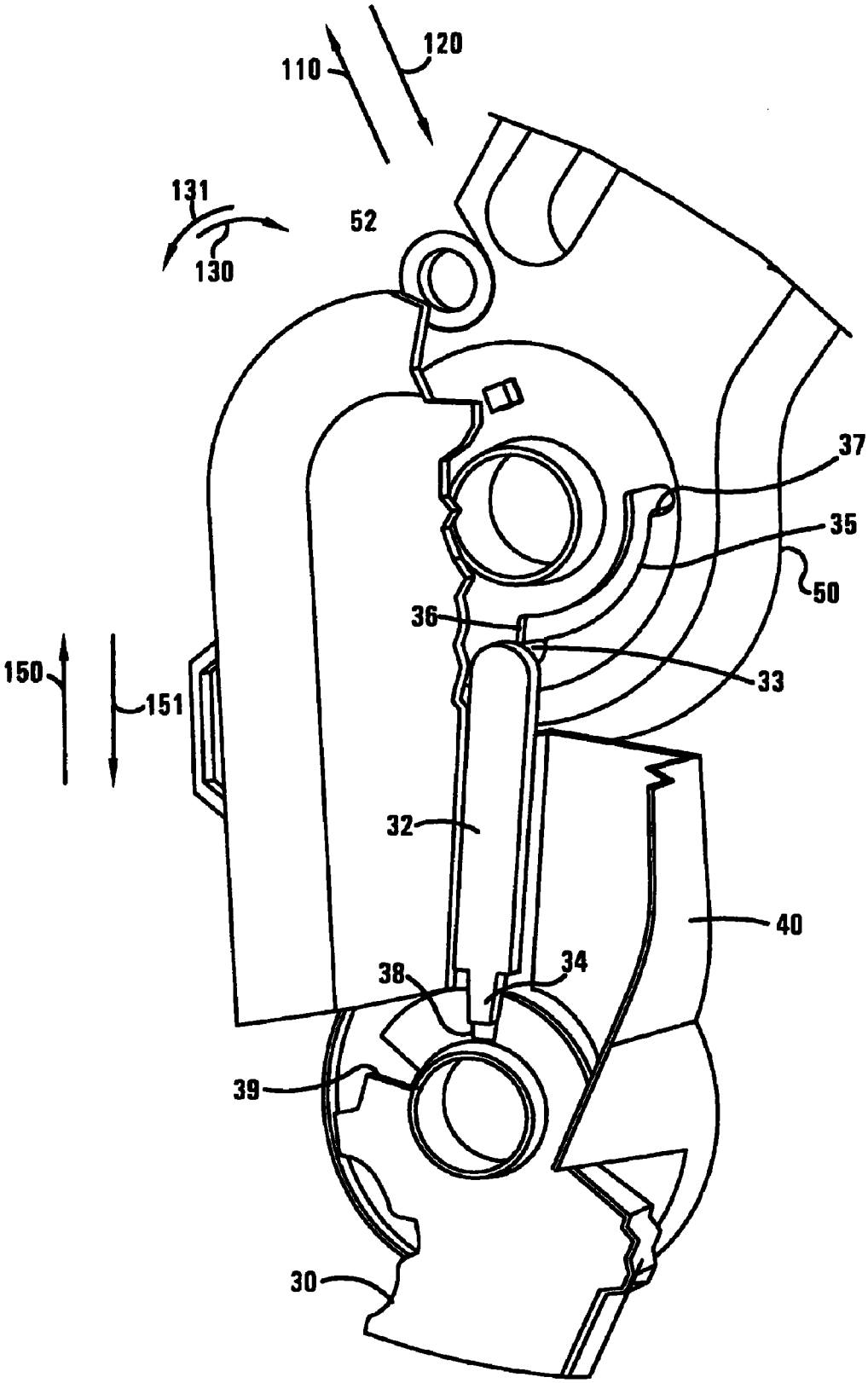
FIG. 7 is a cut away perspective view of portions of the calf and thigh of FIG. 1, taken along the line 7-7
Figure 8:
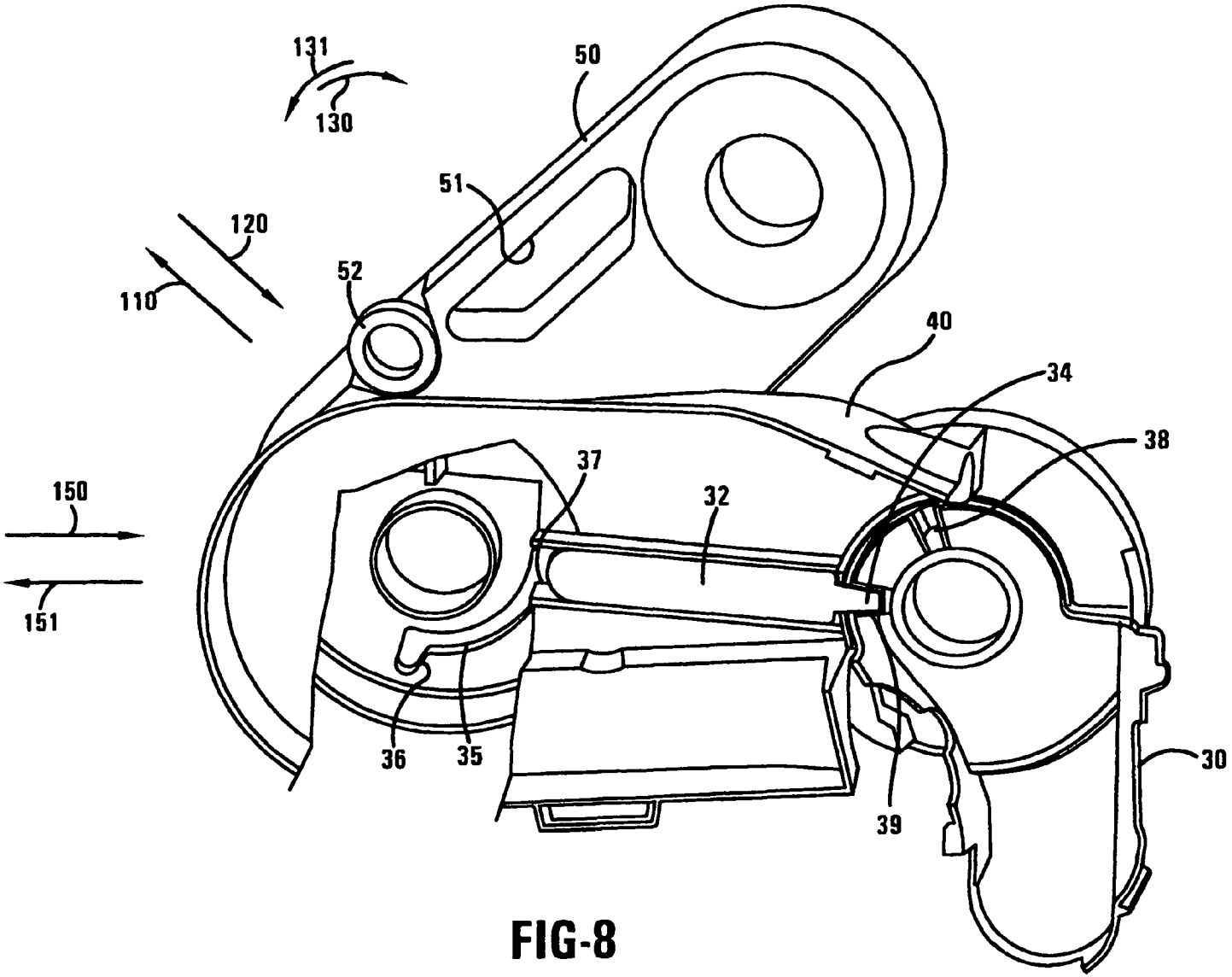
FIG. 8 is a view similar to FIG. 7, but showing portions of the link, calf and thigh in the canister.

Referring now to FIGS. 6-8, there is shown the mechanism that allows the unit to convert between upright and canister modes. The thigh 50 includes a locking pin 52 which is adapted to move in the general direction of arrows 110, 120 and is spring biased (not shown) in the direction of arrow 120. The locking pin 52 includes an engagement portion 54 adapted to engage a slot 56 having an upright detent 58 and a canister detent 59 defined therein. To convert from the upright mode (shown in FIGS. 1 and 6) the locking pin 52 is pulled out of the upright detent 58 in the general direction of arrow 110 which allows the thigh 50 to rotate relative to the calf 40 in the general direction of arrow 130. As the thigh 50 rotates in the general direction of arrow 130, the engagement portion 54 reaches the canister detent 59 and the spring bias on the locking pin 52 secures the engagement portion 54 of the locking pin 52 in the canister detent 59 to lock the thigh 50 to the calf 40 in the canister position shown in FIG. 3. To convert from the canister mode (shown in FIGS. 3 and 8) to the upright mode, the locking pin 52 is pulled out of the canister detent 59 which allows the thigh 50 to rotate relative to the calf 40 in the general direction of arrow 131. As the thigh 50 rotates in the general direction of arrow 131, the engagement portion 54 reaches the upright detent 58 and the spring bias on the locking pin 52 secures the engagement portion 54 of the locking pin in the upright detent 59 to lock the thigh 50 to the calf 40 in the upright position shown in FIG. 1. It should be noted that a carry handle 51 positioned in the thigh 50 is adapted to aid the user in lifting the thigh 50 which allows rotation of the thigh 50 relative to the calf 40.

Referring now the FIGS. 7 and 8, there is shown the ankle release 32 which is adapted to move in the general direction of arrows 150, 151 and is spring biased (not shown) in the direction of arrow 150. The ankle release 32 includes a lower locking portion 34 adapted to engage an upright detent 38 (FIG. 7) or a canister detent 39 (FIG. 8) defined on the link 30. The upper portion of the ankle release 32 includes a cam follower 33 adapted to engage a cam slot 35 defined in the calf 50. The cam slot 35 includes a cam surface 36 and cam surface 37.

The cam surface 36 is adapted to allow the cam follower 33 to move in the general direction of arrow 151 as the thigh 50 is rotated relative to the calf 40 is rotated in the general direction of arrow 130. It should be appreciated that as the cam follower 33 of the ankle release 32 moves in the general direction of arrow 151, the lower locking portion 34 of the ankle release 32 is removed from the upright detent 38 of the link 30, thus allowing the calf 40 to rotate relative to the link 30 in the general direction of arrow 131. When the locking portion 34 of the ankle lock 32 is proximate to the canister detent 39, the spring bias on the ankle lock 32 causes the locking portion 34 to engage the canister detent 39 to lock the calf 40 to the ankle 30 in the canister mode (FIG. 8).

The cam surface 37 is adapted to allow the cam follower 33 to move in the general direction of arrow 151 as the thigh 50 is rotated relative to the calf 40 in the general direction of arrow 131. It should be appreciated that as the cam follower 33 of the ankle release 32 moves in the general direction of arrow 151, the lower locking portion 34 of the ankle release 32 is removed from the canister detent 39 of the link 30, thus allowing the calf 40 to rotate relative to the link 30 in the general direction of arrow 130. When the locking portion 34 of the ankle lock 32 is proximate to the upright detent 38, the spring bias on the ankle lock 32 cause the locking portion 34 to engage the upright detent 38 to lock the calf 40 to the ankle 30 in the upright mode shown in FIGS. 1 and 3.

To summarize the conversion from upright mode, shown in FIG. 7 to canister mode, shown in FIG. 8, the locking pin 52 is retracted to allow the thigh 50 to rotate relative to the calf 40 in the general direction of arrow 130. Second, rotation of the thigh 50 relative the calf 40 releases the ankle lock 32 which allows the calf 40 to rotate relative to the link 30 in the general direction of arrow 131. Finally, as the conversion process is completed the locking pin 52 locks the thigh 50 to the calf 40 via the canister detent 59 and the ankle lock 32 locks the link 30 to the calf 40 via the canister detent 39.

To summarize the conversion from canister mode, shown in FIG. 8, to the upright mode, shown in FIG. 7, the locking pin 52 is retracted to allow the thigh 50 to rotate relative to the calf 40 in the general direction of arrow 131. Second, rotation of the thigh 50 relative the calf 40 releases the ankle lock 32 which allows the calf 40 to rotate relative to the link 30 in the general direction of arrow 130. Finally, as the conversion process is completed the locking pin 52 locks the thigh 50 to the calf 40 via the upright detent 58 and the ankle lock 32 locks the link 30 to the calf 40 via the upright detent 38. Again, the handle 51 is provided to allow the operator to assist conversion from canister mode to upright mode.

Figure 6A:
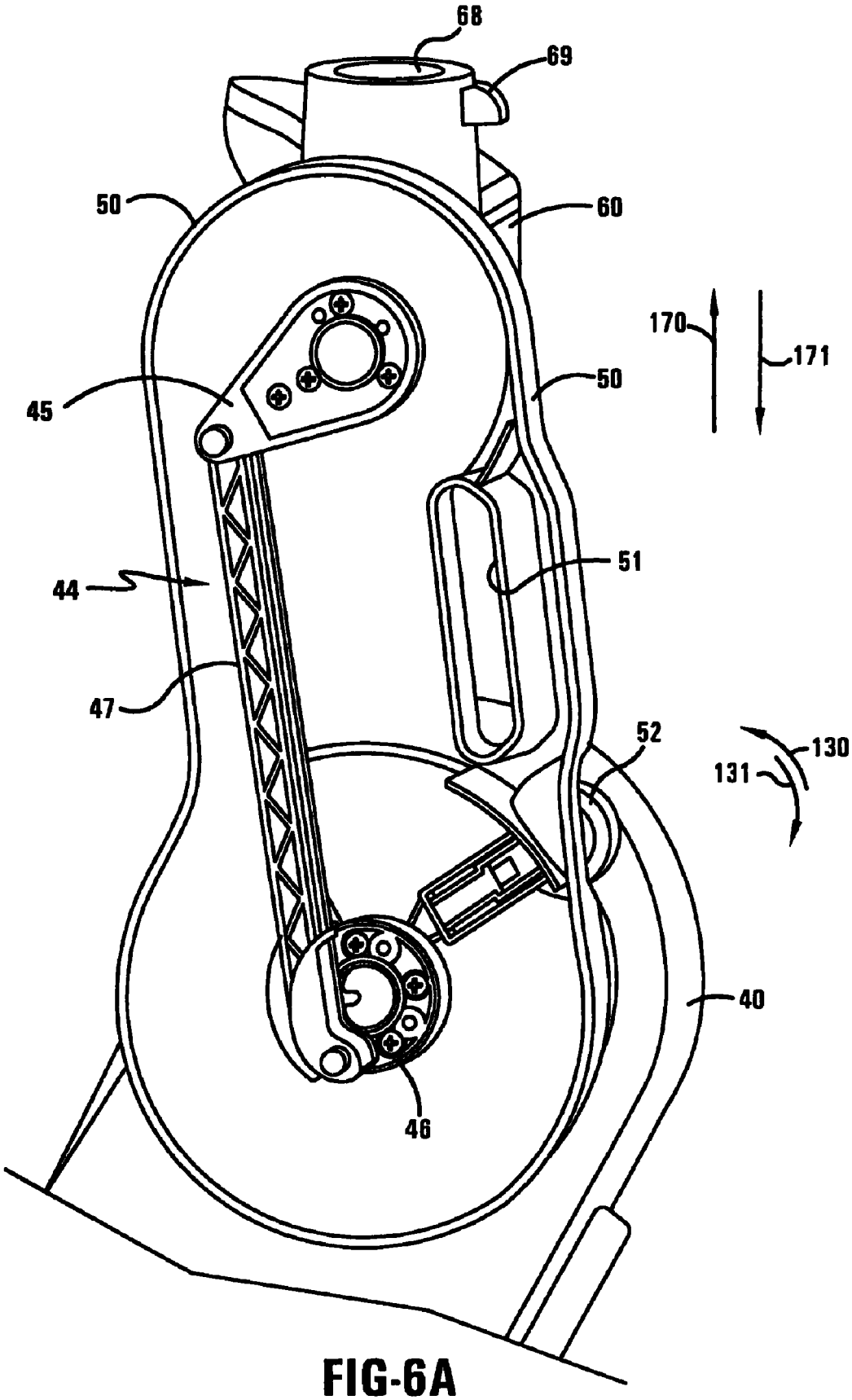
FIG. 6A is a view similar to FIG. 6, but showing a linkage between the calf and control pad.

Referring now to FIG. 6A, there is shown an internal linkage 44 between the thigh 40 and the control pad 60. The linkage include a arm 45 secured to the control pad 60 and free to rotate about the thigh 50 in the general direction of arrows 130, 131 The linkage 44 further includes a ring 46 secured to the calf 40 and free to rotate relative to the thigh 50 in the general direction of arrows 130, 131. The linkage 44 further includes a rod 47 which links rotation of the arm 45 to the ring 46. In operation, when the cleaner is moved from the upright mode, shown in FIG. 6A, the calf 40 rotates downward in the general direction of arrow 131 which causes the ring 45 to rotate relative to the thigh 50 in the general direction of arrow 131 which pushes the rod 47 upward to which causes to arm 45, and hence the control pad 60 to rotate relative to the thigh 50 in the general direction of arrow 131. Hence as the unit is converted from the upright storage position, shown in FIG. 1, to the canister position shown in FIG. 3, the control pad 60 and handle 70 are maintained in a vertical orientation, even though the angle of the thigh 50 has changed from substantially vertical (FIG. 1), to partially horizontal (FIG. 3). This linkage allows the cleaner to be used as a conventional upright as shown in FIG. 1, and a canister with an easy to reach wand as shown in FIG. 3. It should also be appreciate that by changing the length of the rod 44 the angle of the control pad could be changed moderately rather than maintained in the vertical position.

Figure 9:
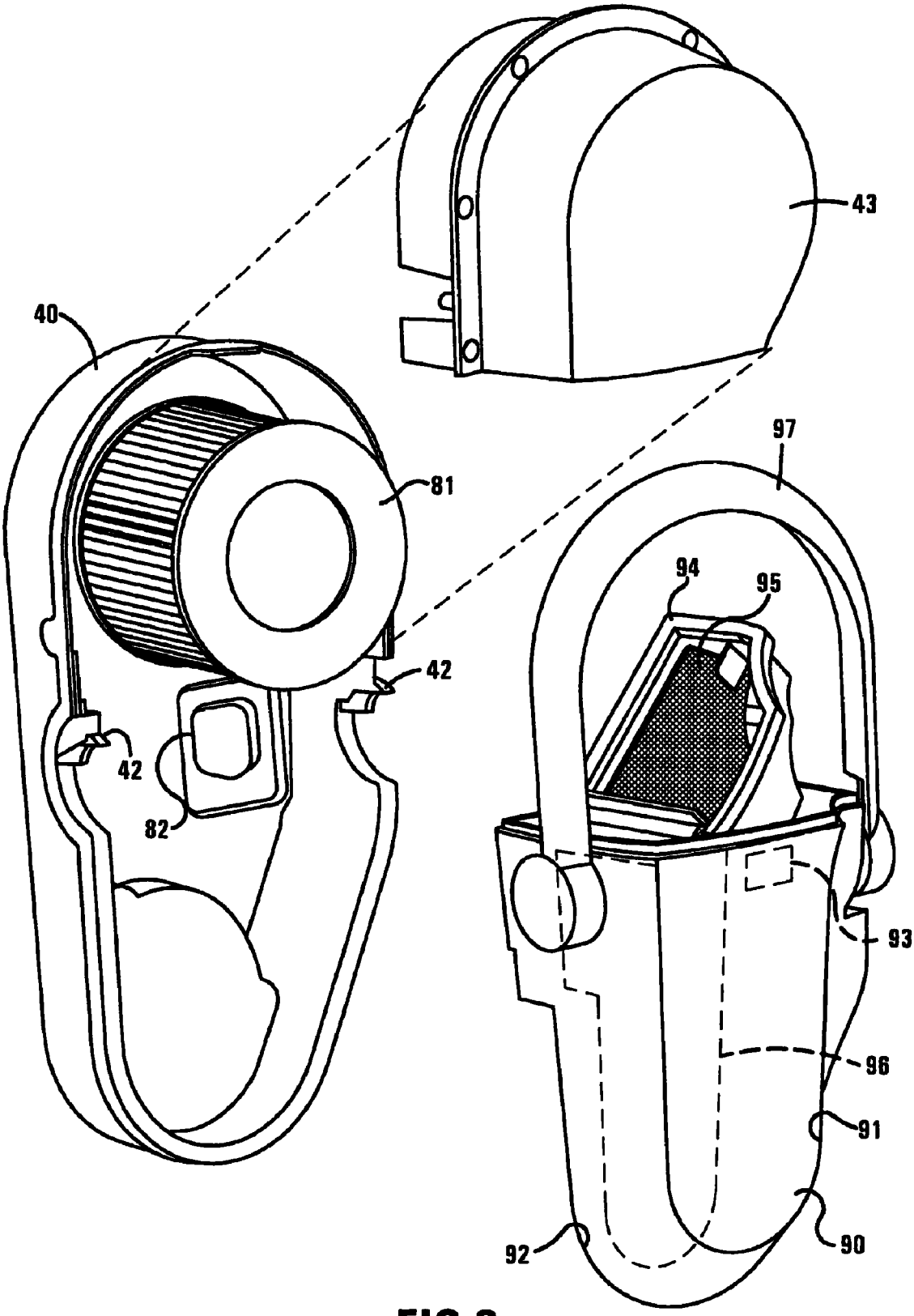
FIG. 9 is a perspective view of the dirt separation system showing both the dirt cup and filter cover removed from the calf.
Figure 10:
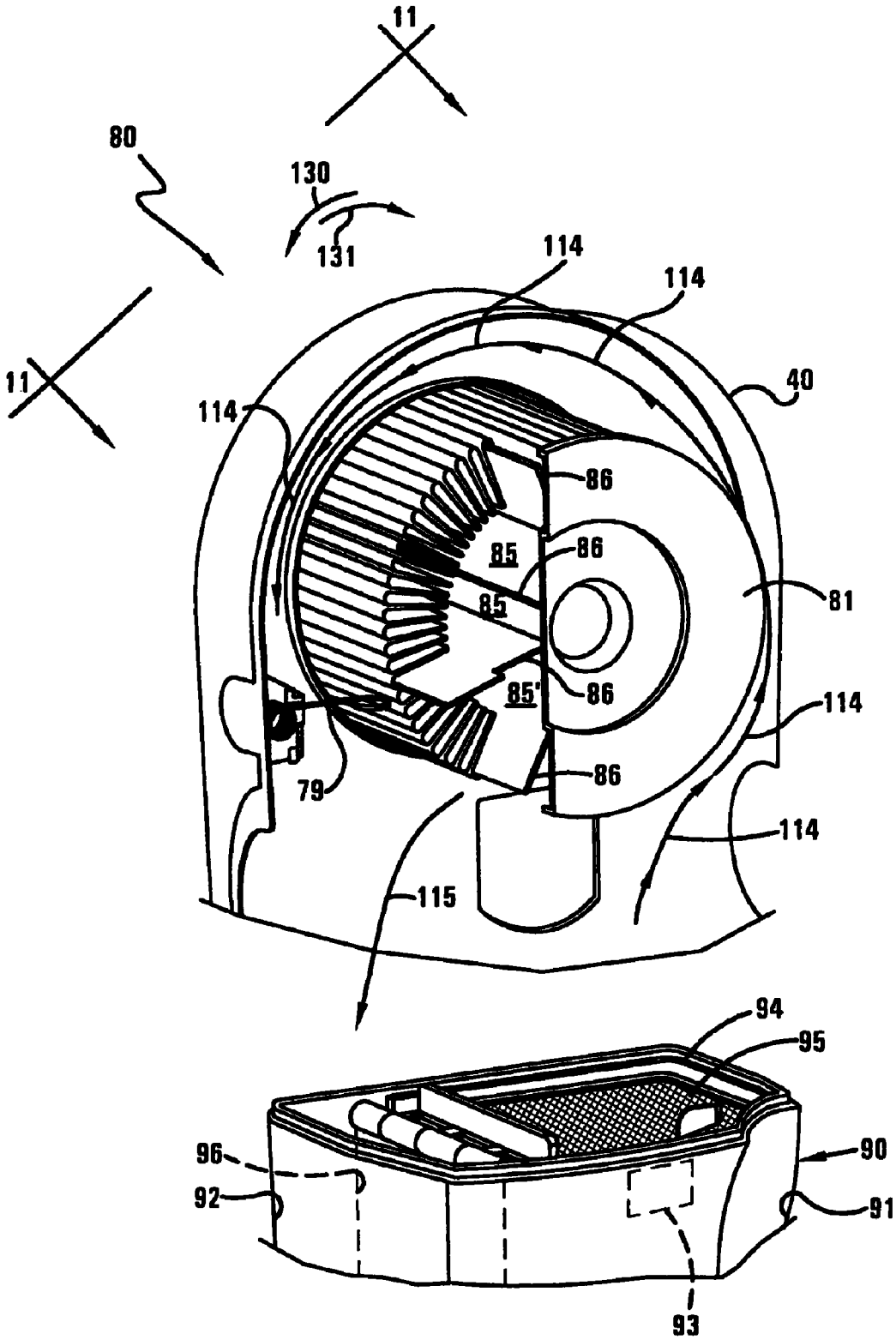
FIG. 10 is an enlarged cutaway view of the filter system and portion of the dirt cup shown in FIG. 9.
Figure 11:
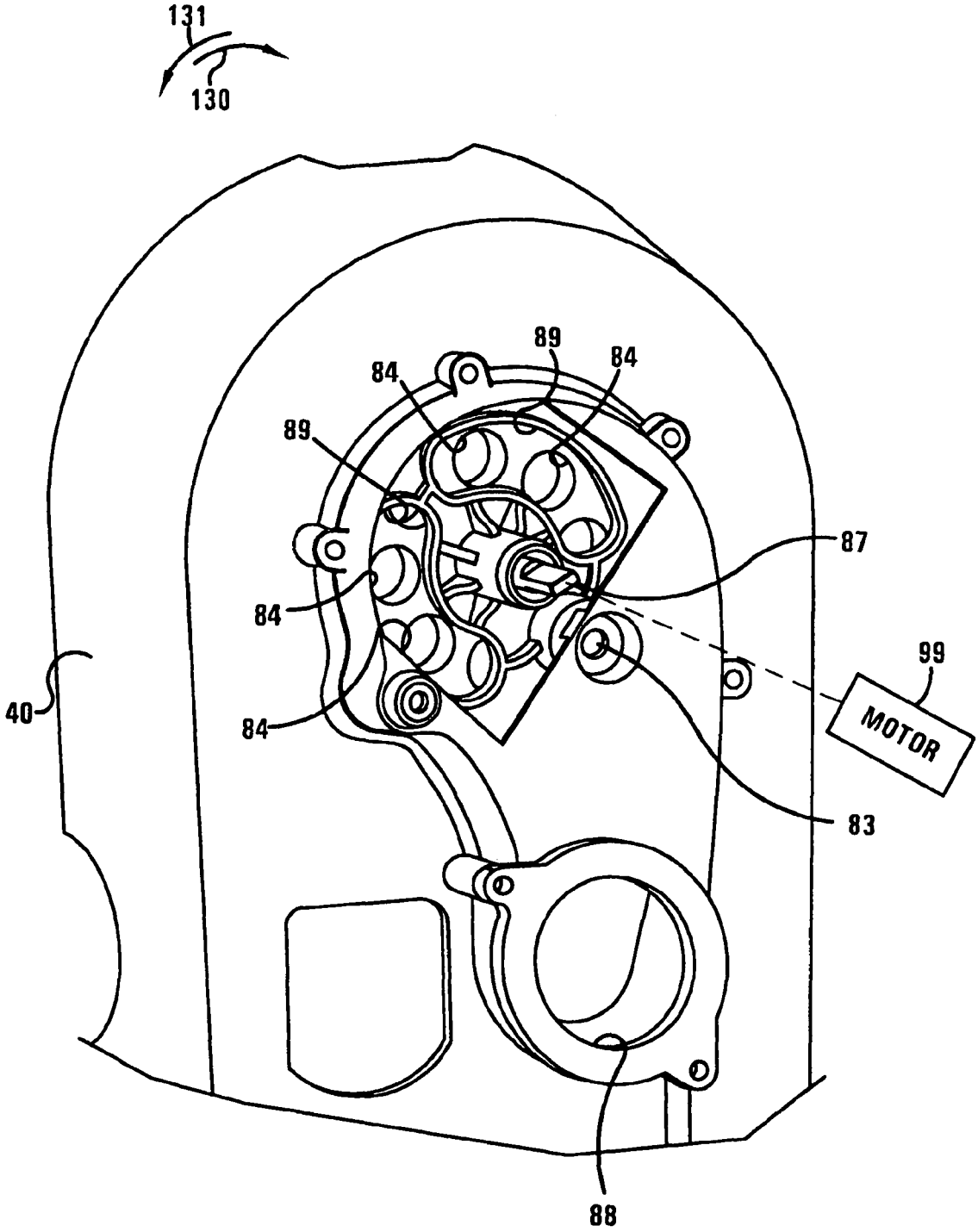
FIG. 11 is reverse partially cutaway perspective view of portions of the filter system of FIG. 9, taken along the line 11-11.

Referring now to FIGS. 9-11 there is shown the dirt separation system 80 of the cleaner 10. The dirt separation system 80 includes a regenerative filter 81 and a removable dirt cup 90. As shown in FIG. 8, both a filter cover 43 of the calf 40 and dirt cup 90 are removed for clarity of description. In operation, these components are sealed to around the filter 81 to receive the dirt laden air stream from the nozzle 24 and direct clean air to the suction source 18. The suction source includes a removable final filter 19 for filtering particles generated by the suction source. The dirt cup 90 includes an inlet 93, a first stage collection chamber 91, and a second stage collection chamber 92. The upper portion of the first stage separation chamber 91 is sealed by lid 94 including a course filter or screen element 95 adapted to separate large particles in the airstream. The first stage separation chamber 91 of the dirt cup 90 is sealed from the second stage separation chamber 92 by a divider wall 96 that prevents particles in the first stage separation chamber 91 from migrating to the second stage separation chamber 92. The lid 94 is pivotally attached to the top of the dirt cup 90 (see FIG. 9) such that particles in the first stage separation chamber 91 maybe be emptied along with the contents of the second stage separation chamber 92 by inverting the dirt cup 90. A carry handle/latch 97 is provided to secure and unsecure the dirt cup 90 to the calf 40 via a pair of locking lugs 42. Also, the handle/latch 97 aids in manipulating the dirt cup 90.

A second embodiment of the invention could have the entire filter 81, cover 43 and dirt coup removable as a single unit. In this alternate configuration, the screen element 95 would be fixed between the first stage collection chamber 91 and the filter 81. In order to empty the both the first stage collection chamber 91 and second stage collection camber 92, the floor of the dirt cup could be replaced with a movable member. Such a movable member would allow both chambers 91, 92 to be emptied without inverting the dirt cup. A latch would hold the member on the dirt cup to prevent leakage during operation. While such a unit has advantages in emptying dirt, it has some disadvantages associated with repeatedly sealing the filter 81 to the cleaner 10. However, it is well within the anticipated scope of this invention to allow the filter to be removed as a unit with the chambers 91, 92.

The dirt laden air is drawn from either the nozzle 24 of the or wand 72 of the handle 70 to the dirt separation system 80 via conduits by airflow created by the suction source 18. As air enters the dirt separation system 80 via an inlet 82, the air is directed into the first stage separation chamber 91 via the inlet 93 of the dirt cup 90. The air is expanded and passed through the screen element 95 to separate large particles from the air stream. The air from the inlet 93 is directed substantially parallel to the screen element 95 in order to prevent large particles from matting on the screen element 95 and blocking airflow out of the first stage collection chamber 91.

The filter 81 is divided into several sealed chambers 85 by divider walls 86 as shown in FIG. 10. Each sealed chamber has a exit port 84 (see FIG. 11) defined in the base thereof. The filter element 81 is rotated about an axle 87 (see FIG. 11) in the general direction of arrow 130 by a filter motor 99 (shown schematically in FIG. 11). The filter motor 99 can be selectively controlled via input signals generated from the CPU 100. Referring now to FIG. 11, it can be seen that most of the exit ports 84 of the sealed chambers 85 are placed into fluid communication with an outlet duct 88 via one of the pair of oblong holes 89. However, the exit port 84 of one segment 85' is placed on to contact with a bleed hole 83 which admits a controlled flow of atmospheric air into the sealed section 85'. This flow of atmospheric air causes a reverse airflow 115 (see FIG. 10) which blows fine particles from the exterior of the filter 81 into the secondary collection chamber 92. It should be appreciated that the while the secondary collection chamber 92 could be sealed from the rest of the dirt collection system 80, this is not necessary as the pressure and airflow from the reverse airflow 115 is adequate to keep the particles contained in the secondary collection chamber 92.

The material of the filter element 81 includes a first inner layer formed of a melt-blown polypropylene, a second middle layer formed of a spun-bond polyester and an outer third layer formed of an expanded polytetrafluoro-ethylene (ePTFE) membrane. The ePTFE outer layer provides non-stick properties to the filter element 81 and allows any dirt or dust accumulated on the filter element 81 to be easily displaced therefrom. Although the filter element 81 is shown and described as having three layers, it is understood that the filter material may include any number of layers or be formed of any number of materials such as a micro-glass or a melt-blown polyester without affecting the concept of the invention. As the filter rotates, each pleat adjacent to the reverse flow chamber 85' comes into contact with a mechanical agitator 79. the mechanical agitator serves two purposes, first, spreading each pleat improves air flow and dust shedding from an exterior of the filter 81. Second, the flicking action as each pleat is spread, agitates imbedded dirt and aids in the reverse air flow 115 in removing small particles from the exterior surface of the filter 81. Also, other types of mechanical agitation, such as vibration and brushing the exterior surface of the filter 81 alternatives contemplated within the scope of this invention.

Thus, in operation, air that has passed through the coarse filter 95 in the lid 94 of the dirt cup 90 flows into the chamber surrounding the filter (i.e. between the filter 81 and the cover 43). As the airstream passes through the filter 81, small particles (i.e. particles small enough to pass through the screen 95 but too large to pass through the filter 81) are collected on the outer surface of the filter 81. This filtered air then continues on to the suction source 18. However, as the filter 81 is rotated by the motor 99, each sealed chamber 85 will pass through the position shown as 85' and the small particles will be cleaned from the surface of the filter 81. The filter 81 is cleaned by a combination of one or more of the following effects: the reverse airflow 115 which blows the particles down into the secondary collection chamber 92, spreading of the pleats by the agitator 79 which aides the airflow, the flicking action of the agitator 79 which releases particles from the filter 81, and gravity which helps the downward movement of the particles toward the secondary collection chamber after they have been freed from the surface of the of the filter 81. Thus, is should be appreciated that as this cleaner is operated, a section of the cleaner adjacent to the chamber 85' is not used to filter particles, but instead is subject too a process which cleans the filter. As each segment 85 of the filter 81 goes sequentially through this process, it is brought to a improved performance state close to that of a new filter. Thus, the performance of the filter 81 regenerates with use, and the sustained performance is maintained over a longer period of time without the operator replacing or cleaning filter components. Because operation of the cleaner 10 is controlled by the CPU 100, it is possible to operate the cleaner 10 to improve the regenerative properties of the filter system.

Figure 12:
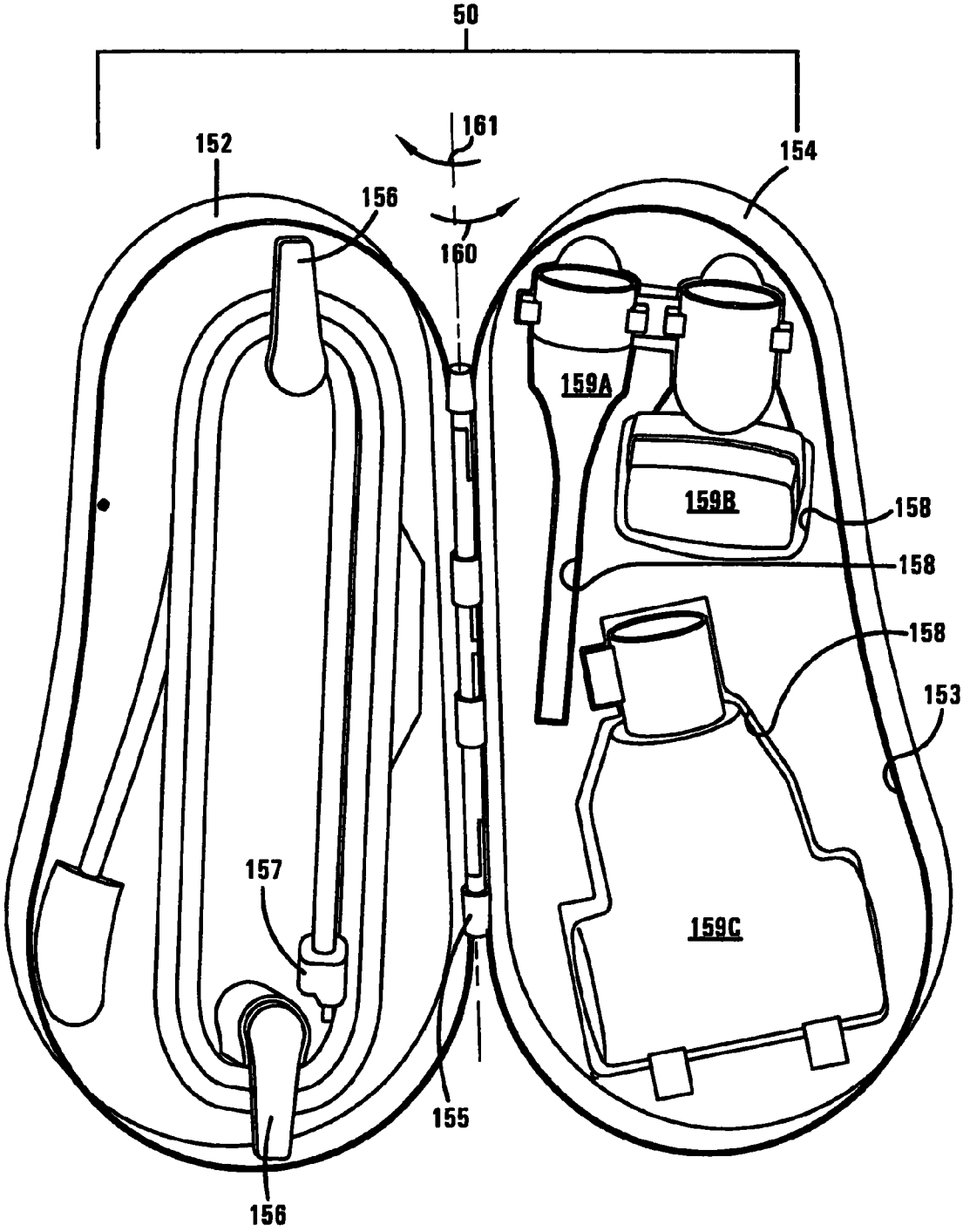
FIG. 12 is a perspective view of the thigh portion of the cleaner shown in FIG. 1, taken along the line 12-12 and showing the cover in an open position.

Referring now to FIG. 12, there is shown the calf 50. The calf 50 includes a base 152 and a cover 154 hingedly connected to the base 152 by a hinge 155. The door 154 includes an opening 153 defined in a rear portion thereof. The base 152 includes a pair of cord hooks 156 about which the cord 157 may be wrapped. The cord 157 supplies electric power to the suction source 18, carpet height adjustment 28, agitator motor 29, LED array 21 and filter motor 99. The cover 154 includes a number of recesses 158 defined therein. These recesses 158 are adapted to receive a number of cleaning tools such as a crevice tool 159A, upholstery tool 159B, turbine tool 159C or other tools (not shown). Other tools could include tools such as a hard floor nozzles or combination tools which combine the features of one or more of the above tools. It should also be appreciated that alternate configurations of the cleaner 10 could have tool storage on the base 152 or on the outer surface of the cover 154 such that the tools could be accessed without opening the cover 154.

To place the cover 154 in the open position, shown in FIG. 12, the lid 154 is unlatched from the base 152 and rotated in the general direction of arrow 160. To return the cover 154 to a storage position, the cover 154 is rotated in the general direction of arrow 161 and latched to the base 152. It should be appreciated that when placed in the storage position, the interior of the thigh 50 can be accessed via the opening 153. As shown in FIG. 4, the cord 157 can be unwound and fed through the opening 153 such that the cleaner 10 may be operated with the any excess cord length not viewable from the exterior of the cleaner 10. The use of the cover 154 in conjunction with the opening 153 allows the cleaner to maintain a clean profile while the cord is stored (FIGS. 1-3) or unwound to use the product (FIG. 4).

Figure 13:
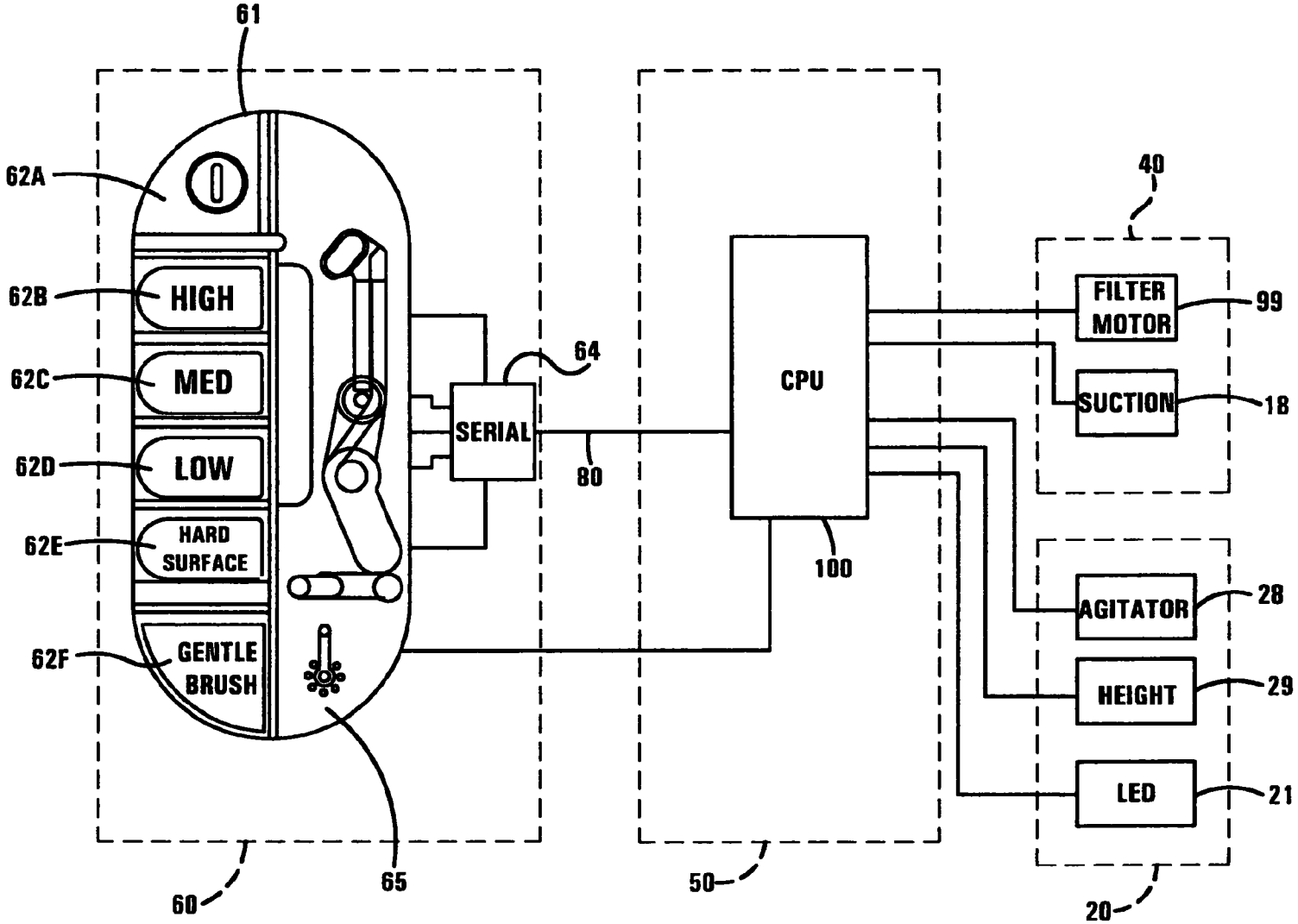
FIG. 13 is a partial schematic view of the electric control system of the vacuum cleaner shown in FIG. 1.

Referring now to FIG. 13, there is shown a partial schematic view of the control system of the cleaner 10. A control panel 61 is placed on the control pad 60. The control panel 61 includes a number of selector switches 62 to control various aspects of the cleaner. Switch 62 A is an on/off selector switch which controls the overall power supplied to the cleaner. Switches 62B, 62C, and 62D respectively select a high, medium or low setting for the carpet height adjustment 29. Switch 62E selects a hard surface mode which i) places the agitator at a low setting, ii) powers the agitator motor 28 at a slow speed, and iii) supplies full power to the suction motor 18. Switch 62F selects a gentle or quiet mode whereby both the agitator motor 28 and the suction source 18 are run at less than maximum speed to reduce noise output from the cleaner. Inputs from each of the switches 62A-F are fed into a serial controller 64 which stores the state of each of the switches 62 A-F. The serial controller 64 then sends a single combined control signal to the CPU 100 located in the thigh 50. The serial controller is a conventional UART (universal asynchronous receiver transmitter) which send binary data to the CPU 100 The use of the serial controller 64 allows a pair of conductor to transmit a large amount of data over a single set of control wires 80. The advantage of this is clearly apparent when the control wires 80 must pass through a pivot joint such as the joint between the control pad 60 and the thigh 50. Moreover, the CPU 100 could easily be located in the foot 20. Such placement of the CPU 100 would necessitate that control signals be passed through joints between the control pad 60 and thigh 50, the thigh 50 and the calf 40, the calf 40 and the link 30, and finally from the link 30 to the foot 20. The use of serial communication via a single set of control wires 80 would greatly reduce the complexity of the wiring through these four joints.

The CPU 100 is operative to receive serial control data from the serial controller 64. A program in the CPU 100 can then determine the state of all the control switches from the serial data. After processing the serial data, the CPU 100 generates control signals to control the filter motor 99, and suction source 18 located in the calf 40. In addition, the CPU 100 generates control signals to control the agitator motor 28, carpet height adjustment 29, and LED emitter array 21 in the foot 20 of the cleaner 10. Moreover, the CPU 100 can generate a control signal for a warning light 65 on the control panel 61 which warns the operator of potential problems, such as overheating.

One of the novel features of the cleaner 10 is the regenerative filter system 80 which moves part of the filter media through a cleaning cycle during use of the cleaner. Utilizing the control system of the present invention, it is possible to operate the unit 10 in a manner that either enhances or slows down the regenerative cleaning process. The CPU 100 could operate the regenerative filter motor 99 in conjunction with the suction motor 18 in such a way to improve the state of the filter 81. This may include a filter cleaning cycle whereby the suction and filter are operated for a period of time only to clean the filter 81. It may be desirable to have additional feedback sensor to monitor system pressure, airflow, temperature or other performance factor to maintain performance that is always as good a new filter. All prior art vacuum cleaners, including cyclonic units, rely on filter replacement and not filter cleaning to restore filter performance.

Figure 14:
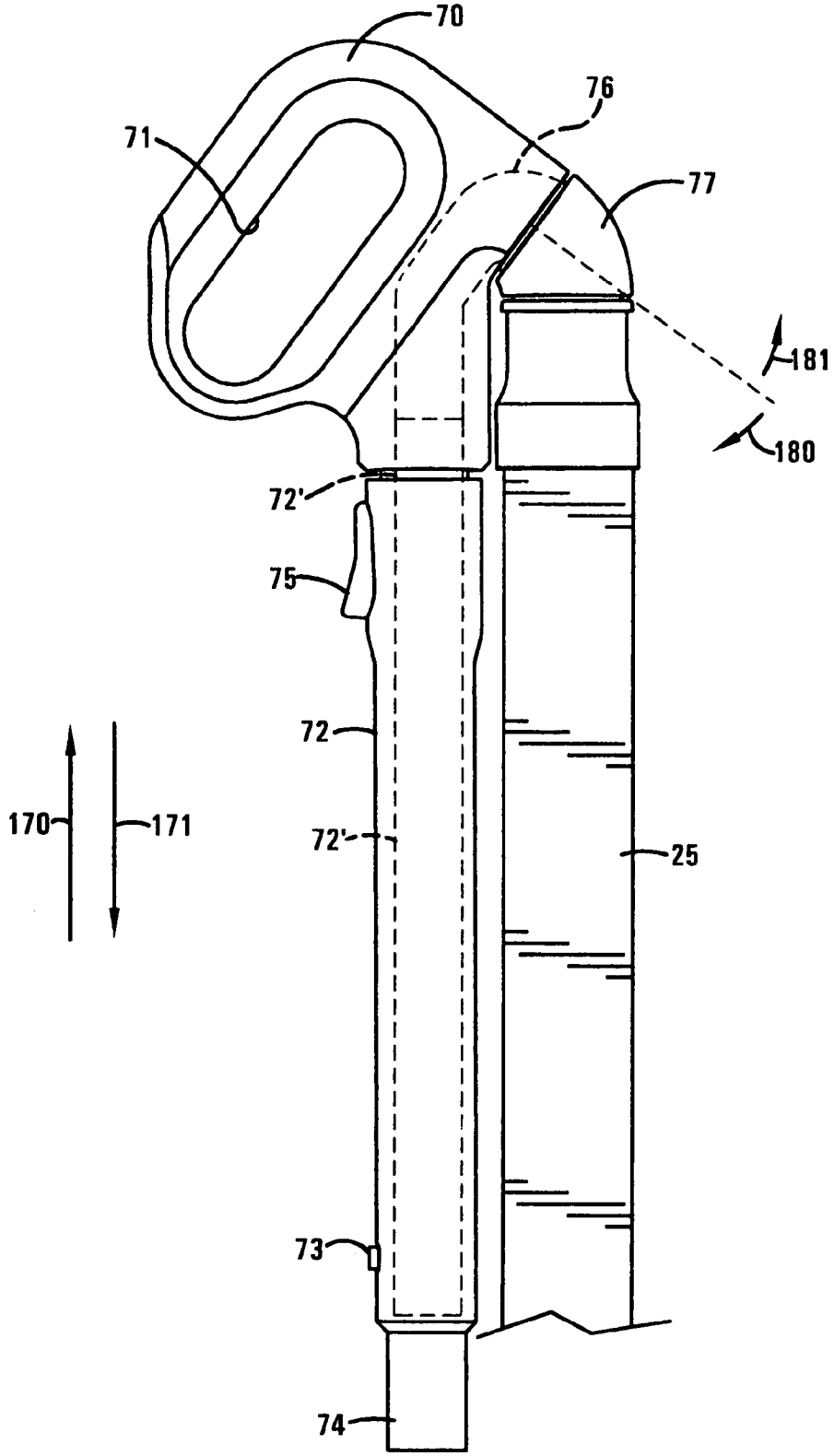
FIG. 14 is a left perspective view of the handle and wand assembly.
Figure 15:
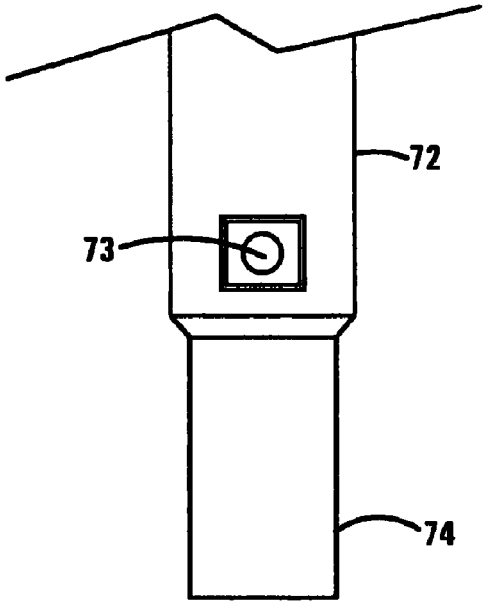
FIG. 15 is a front perspective view of the control pod and portion of the wand.
Figure 15:
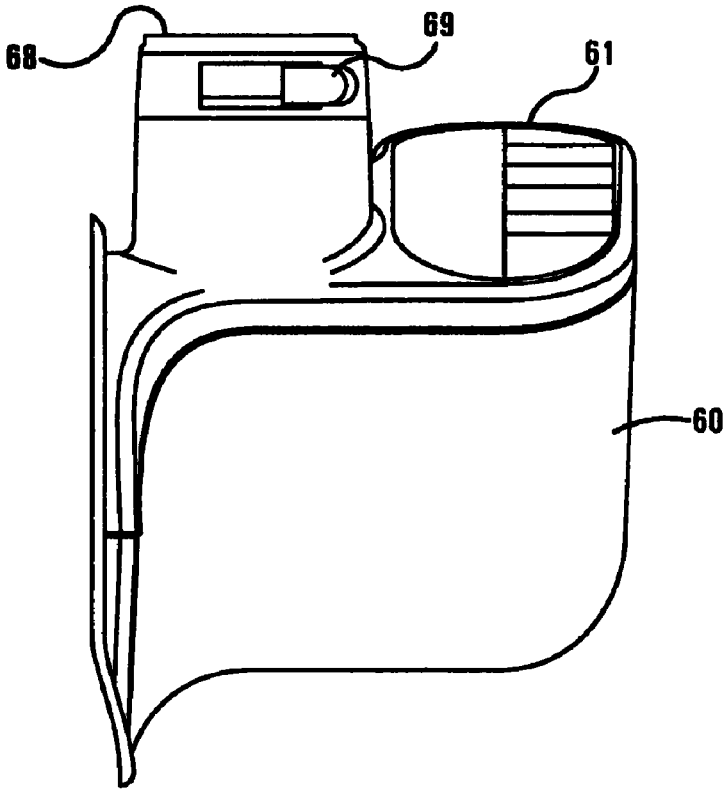

Referring now to FIGS. 14 and 15, there is shown the handle 17 removed from the cleaner 10. The handle 70 includes a wand portion 72 having an internal tube 72' which slidably attached to the interior of the wand 72. A wand lock 75 releases the two portions 72 and 72' such that the length of the wand may be increased by pulling the portion 72' in the general direction of arrow 170, or the length of the wand may be decreased by telescoping the portion 72' into the wand 72 in the general direction of arrow 171. The wand 72 includes an end 74 adapted to attach to the tools 159A, 159B or 159C. The handle further includes a loop grip 71 having a soft gripping surface which is angled at approximately 45 degrees from the axis of the wand 72. Also, angled at about 45 degrees is an internal suction conduit 76 which hooks into a swivel joint 77 connected to the flexible hose 25. The swivel joint 77 allows the handle 70 to rotate relative to the flexible hose 25 in the general direction of arrow 180, 181. The combination of the internal passage 76 and swivel joint 77 allows to the flexible hose 25 to hang parallel to the wand 72 and aids in storing the hose in both the upright position shown in FIG. 1 and the canister position shown in FIG. 2. When the wand 72 is used for above the floor cleaning, this swivel action helps prevent the hose 25 from becoming twisted as the operator moves the wand about the room to be cleaned.

The wand 72 further includes a locking lug 73. The locking lug 73 is adapted to be engaged by a slide latch 69, shown in FIG. 15. Securing the locking lug 73 to the slide latch 69 securely fastens the handle 70 to the control pod 60 and thus the remainder of the cleaner 10. To secure the handle 70 to the cleaner 10, the slide latch 69 is positioned in the open position shown in FIG. 15. The end 74 of the wand 72 is slid into an opening 68 defined in the top of the control pod 60 until the locking lug 73 of handle 70 engages a set of locking lugs (not shown) on the slide latch 69. The slide latch 69 is then moved from the open position, shown in FIG. 15, to a latched position shown in FIG. 1, thereby securing the handle 70 to remainder of the unit. It should be noted that in the latched position the opening 68 seals the end 74 such that all suction is directed to the nozzle 24 in the foot 20. Therefore a valve is not needed to select between above the floor cleaning and carpet cleaning.

It should be appreciated that when the handle 70 is secured to the cleaner 10, as shown in FIGS. 1 and 3, the wand lock 75 can be released and the wand 72 can be extended in the direction of arrow 170 or retracted in the direction of arrow 171. Extending the wand 72 in the general direction of arrow 170 allows the height of the handle 70 to be adjusted for users who prefer a longer and higher handle, and retracting the wand 72 in the general direction of arrow 171 allows the handle 70 to be adjusted for users who prefer a shorter and lower handle 70. In addition, it should be appreciated that in the above the floor cleaning, the changing the length of the wand 72 can provide greater reach similar to that available in canister cleaners.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

The invention claimed is:

1. A control system for a vacuum cleaner comprising:

a plurality of electric devices;

a control pad for generating a number of user inputs;

a serial controller for reading the state of the number of inputs and generating serial data in response thereto representing the state of the number of inputs; and a processor connected to the serial controller by a control wire passing through at least one pivot joint of the vacuum cleaner and adapted to receive the serial data and generate control signals that controls at least one of the electric devices based on the serial data;

wherein one of the electric devices is a height adjustment motor.

2. The control system of claim 1, wherein one of the electric devices is a warning light that warns an operator of potential problems.

3. A control system for a vacuum cleaner including a nozzle, the control system comprising:

a plurality of electric devices including an agitator motor, a height adjustment motor, and a suction motor;

a control pad for generating a number of user inputs;

a serial controller for reading the state of the number of inputs and generating serial data in response thereto; and a processor adapted to receive the serial data and generate control signals that controls a number of the electric devices;

wherein a single user input is converted to serial data which causes the processor to generate a plurality of control signals; and wherein the single user input selects a hard floor mode input, and the controller generates signals which i) operate the agitator motor at reduced speed, ii) set the height adjustment motor to position the nozzle at a low height, and iii) operate the suction motor at substantially full power.

4. A method of operating a vacuum cleaner comprising the steps:

entering a number of user inputs;

converting the user inputs to serial data representing the user inputs;

receiving the serial data with a controller;

generating, at the controller, a number of vacuum cleaner control signals in response to the received serial data for controlling the operation of a plurality of electric devices included in the vacuum cleaner; and controlling the speed of a height adjustment motor based on the vacuum cleaner control signals.

5. The method of claim 4, further comprising the step of controlling an illumination device.

6. The method of claim 4, wherein:

the entering step includes entering a single user input, and the generating step includes generating a plurality of control signals.

7. The method of claim 6, wherein:

the single input is the selection of a hard floor mode, and the generating step generates a control signal which i) operates an agitator motor at reduced speed, ii) set the height adjustment motor to position a nozzle at a low height, and iii) operates the suction motor at substantially full power.

* * * * *